US012083402B2

(12) United States Patent
Yu et al.

(10) Patent No.: US 12,083,402 B2
(45) Date of Patent: Sep. 10, 2024

(54) FLEXIBLE TRAINER STAND FOR INDOOR CYCLING

(71) Applicant: QINGDAO MAGENE INTELLIGENCE TECHNOLOGY CO., LTD., Qingdao (CN)

(72) Inventors: Feng Yu, Qingdao (CN); Xigang Zhao, Qingdao (CN)

(73) Assignee: QINGDAO MAGENE INTELLIGENCE TECHNOLOGY CO., LTD., Qingdao (CN)

( * ) Notice: Subject to any disclaimer, the term of this patent is extended or adjusted under 35 U.S.C. 154(b) by 34 days.

(21) Appl. No.: 17/775,595

(22) PCT Filed: Sep. 16, 2020

(86) PCT No.: PCT/CN2020/115466

§ 371 (c)(1),
(2) Date: May 10, 2022

(87) PCT Pub. No.: WO2022/052144

PCT Pub. Date: Mar. 17, 2022

(65) Prior Publication Data

US 2022/0387870 A1 Dec. 8, 2022

(30) Foreign Application Priority Data

Sep. 9, 2020 (CN) ..... 202010938336.8

(51) Int. Cl.
*A63B 69/16* (2006.01)
*A63B 22/06* (2006.01)

(52) U.S. Cl.
CPC ..... *A63B 69/16* (2013.01); *A63B 22/0605* (2013.01)

(58) Field of Classification Search
None
See application file for complete search history.

(56) References Cited

U.S. PATENT DOCUMENTS 6,648,802 B2 * 11/2003 Ware ..... A63B 22/0605 482/64
9,782,618 B2 * 10/2017 Curry ..... A63B 21/05
(Continued)

FOREIGN PATENT DOCUMENTS

CN 205598592 U 9/2016
CN 205649818 U 10/2016
(Continued)

*Primary Examiner* — Shila Jalalzadeh Abyaneh
(74) *Attorney, Agent, or Firm* — Bayramoglu Law Offices LLC

(57) ABSTRACT

A flexible trainer stand for indoor cycling includes a bracket, a flat plate, a first guide portion, a second guide portion, and elastic devices. The first guide portion and the second guide portion can slide relative to each other, which is configured for simulating forward and backward movement of a bike generated when a user accelerates and sprints. The first guide portion and the second guide portion can be inclined under an action of the elastic device, which is configured for simulating left and right inclination of the bike generated when the user is cycling and exerting force. A lifting device is arranged on the flat plate, which is configured for simulating position changes of the bike in a vertical direction when a slope changes. Somatosensory feedback of the user during outdoor cycling is truly simulated, and a feedback force can be adjusted.

12 Claims, 6 Drawing Sheets

(56) References Cited

U.S. PATENT DOCUMENTS

| | | | | |
|---|---|---|---|---|
| 10,384,111 | B2 * | 8/2019 | Liao | A63B 21/225 |
| 11,383,127 | B1 * | 7/2022 | Houchin-Miller | A63B 22/0605 |
| 2002/0077221 | A1 * | 6/2002 | Dalebout | A63B 22/0605 482/57 |
| 2002/0147087 | A1 | 10/2002 | Tollner | |
| 2005/0209064 | A1 * | 9/2005 | Peterson | A63B 69/16 482/61 |
| 2010/0288901 | A1 * | 11/2010 | Wallach | A63B 22/0076 248/346.03 |
| 2011/0218080 | A1 * | 9/2011 | Papadopoulos | B62H 1/12 482/61 |
| 2012/0071301 | A1 * | 3/2012 | Kaylor | A63B 21/00058 482/57 |
| 2013/0316827 | A1 * | 11/2013 | Kang | A63F 13/807 463/36 |
| 2016/0199693 | A1 | 7/2016 | Vermilyea et al. | |
| 2016/0279465 | A1 * | 9/2016 | Chang | A63B 22/02 |
| 2018/0169457 | A1 * | 6/2018 | Singh | A61H 1/024 |
| 2019/0022497 | A1 * | 1/2019 | Hawkins, III | A63B 24/0087 |
| 2020/0054919 | A1 * | 2/2020 | Karabush | A63B 21/0428 |
| 2020/0215381 | A1 * | 7/2020 | Bass | A63B 69/16 |
| 2021/0052937 | A1 * | 2/2021 | Chen | A63B 21/0428 |
| 2021/0228939 | A1 * | 7/2021 | McAllister | A63B 22/0605 |

FOREIGN PATENT DOCUMENTS

| | | | | |
|---|---|---|---|---|
| CN | 206424526 | U | 8/2017 | |
| CN | 206672410 | U | 11/2017 | |
| CN | 107648806 | A | 2/2018 | |
| CN | 207253746 | U | 4/2018 | |
| CN | 111093779 | A | 5/2020 | |
| DE | 29816569 | U1 * | 12/1998 | A63B 22/0605 |
| KR | 20180083078 | A * | 7/2001 | A63B 21/4034 |
| KR | 20110104784 | A * | 9/2011 | A63B 22/18 |
| KR | 20180116025 | A | 10/2018 | |

* cited by examiner

FLEXIBLE TRAINER STAND FOR INDOOR CYCLING

CROSS REFERENCE TO THE RELATED APPLICATIONS

This application is the national phase entry of International Application No. PCT/CN2020/115466, filed on Sep. 16, 2020, which is based upon and claims priority to Chinese Patent Application No. 202010938336.8, filed on Sep. 9, 2020, the entire contents of which are incorporated herein by reference.

TECHNICAL FIELD

The present disclosure relates to the field of cycling training equipment, and in particular, to a flexible trainer stand for indoor cycling.

BACKGROUND

Indoor cycling is a relatively safe and efficient form of exercise in the field of public physical training, which can achieve the objective of high-endurance and high-precision cycling training easily with assistance of auxiliary training facilities such as bike trainers and spinning bikes. However, an indoor cycling environment based on the above hardware facilities is solo, which is quite different from the real cycling environment in spite of the assistance of some competitive cycling training Apps. For example, the feedback generated when a user exerts a force, accelerates and sprints, and goes up and down on the road cannot directly or simultaneously acts on the user. During long-term use, the bike control action of the user will form a muscle memory, and there will be greater deviation of the habit of exerting a force and the cycling posture from the actual cycling situation, which will reduce the training effect and the joy of experience during indoor cycling. Moreover, when the user uses a fixed bike trainer for strength training for a long time, a connection position of a rear fork part of a bike and the bike trainer is a main position to absorb energy generated when the bike is inclined and moves forward during cycling, the fatigue wear of the service life of the bike is large, and there are potential safety hazards.

FIG. 1 is a schematic structural diagram of an existing common rocker plate. An adjustable air bag (103) is arranged between an upper flat plate (101) and a lower flat plate (102), and through pressure adjustment, the rocker plate can be adapted to crowds of different weight ranges, which can simulate a force feedback process of left and right inclination of a bike during cycling. In this case, the disadvantage is that it is hardly to simulate a force feedback process of forward movement during cycling and slope changes.

FIG. 2 is a schematic structural diagram of an existing relatively high-end rocker plate. A leaf spring pressing wheel (203) and a pressing wheel guide rail (204) are arranged between an upper platform (201) and a bottom bracket (202), which can simulate the force feedback effect of left and right inclination and forward movement of a bike during cycling. However, its structure is complex and the cost is high. A composite force feedback mechanism formed by the leaf spring pressing wheel and the arc guide rail is relatively rigid, and the feedback force is not adjustable, such that the rocker plate can be adapted to limited user groups. In addition, the arc guide rail used by the force feedback structure that moves forward and backward will cause the center of gravity of the user to rise and fall vertically, which is inconsistent with actual cycling feedback. Moreover, this rocker plate also cannot complete the slope simulation training.

SUMMARY

An objective of the present disclosure is to provide a flexible trainer stand for indoor cycling, so as to solve existing technical problems in the above background art.

In order to solve the above technical problems, a technical solution provided by the present disclosure is as follows: a flexible trainer stand for indoor cycling is provided, including a bracket, a flat plate, a first guide portion, a second guide portion, and elastic devices. The first guide portion is arranged at a top end of the bracket. The second guide portion is arranged at a bottom end of the flat plate. The first guide portion is slidably connected with the second guide portion. A beam is fixedly arranged at one end of the bracket. The elastic devices are symmetrically arranged at two ends of the beam. Each of the elastic devices includes one end fixedly connected with the beam, and the other end fixedly connected with the bottom end of the flat plate.

On the basis of the above technical solution, a contact point of the first guide portion and the second guide portion may have a cross section arranged in an arc shape, a V shape, or a reuleaux triangle shape.

On the basis of the above technical solution, the first guide portion may be arranged as a roller, and the second guide portion may be arranged as a guide rail, or the first guide portion may be arranged as a guide rail, and the second guide portion may be arranged as a roller.

On the basis of the above technical solution, each of the elastic devices may be arranged as a hollow rubber tube. Two ends of the hollow rubber tube may be each provided with a metal joint. A free end of the metal joint may be fixedly connected with the bottom end of the flat plate and the beam separately.

On the basis of the above technical solution, the flexible trainer stand may further include a lifting device fixed on the flat plate. The lifting device may include a roller, a bottom plate, a power mechanism, a conveyor belt, a driving wheel, and a driven wheel. The roller may be arranged at a bottom end of the bottom plate. The power mechanism may be fixedly arranged at a top end of the bottom plate. The driving wheel may be arranged coaxially with the power mechanism. The driving wheel may drive the driven wheel to rotate through the conveyor belt. A connecting member may be fixedly arranged on the conveyor belt.

On the basis of the above technical solution, the power mechanism may include a driving motor, a worm, and a worm gear. The worm may be arranged on the driving motor through a coupler. The worm gear may be meshed with the worm. The worm gear may be arranged coaxially with and rotates synchronously with the driving wheel.

On the basis of the above technical solution, the lifting device may be externally provided with a shell. A sliding chute may be symmetrically formed in a side wall of the shell. The connecting member may be slidably connected in the sliding chute.

On the basis of the above technical solution, a plurality of rollers may be arranged.

On the basis of the above technical solution, the guide rail may have a segmented structure, and any two adjacent sections of the guide rail may be detachably connected.

The technical solutions provided by the present disclosure have the following beneficial effects:

1. In the present disclosure, the first guide portion, the second guide portion, and the elastic device are arranged, and the first guide portion and the second guide portion can slide relative to each other, which can simulate forward and backward movement of a bike generated when a user accelerates and sprints. The first guide portion and the second guide portion can be inclined, and under an action of the elastic device, left and right inclination of the bike generated when the user is cycling can be simulated. Therefore, the above arrangement can enable the user to truly simulate somatosensory feedback during outdoor cycling, and a feedback force can be adjusted, so as to improve an indoor cycling effect.

2. A lifting device is arranged on the flat plate, such that the user can simulate position changes of the bike in a vertical direction when a slope changes, and a simulated feedback effect is real, which improves an experience of indoor cycling.

3. By arranging the elastic device as a passive energy storage device, the flexible support design reduces a stress on a cycling training frame, prolongs a service life, and reduces training costs. In addition, the number and specification of the elastic device can be replaced, and the elastic device can be selected according to the needs of the user such as an actual weight, which can effectively improve comfort of the user during cycling training.

4. The present disclosure also has the advantages of simple structure, ultra-silence, and light weight, is convenient to use and carry, can support all commercially available cycling training equipment such as bike trainers and spinning bikes, and has a wide range of application.

DETAILED DESCRIPTION OF THE EMBODIMENTS

Figure 1:
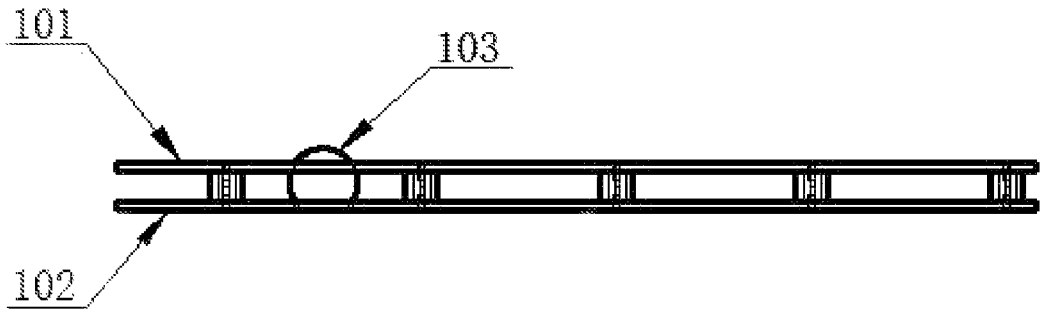
FIG. 1 (Prior Art)
FIG. 1 is a schematic structural diagram of an existing common rocker plate.
Figure 2:
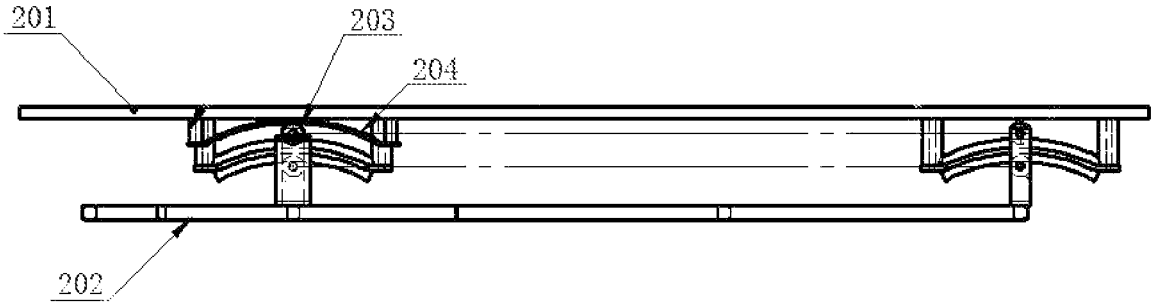
FIG. 2 (Prior Art)
FIG. 2 is a schematic structural diagram of an existing relatively high-end rocker plate.

The present disclosure is described in further detail below with reference to the accompanying drawings and embodiments:

In the present disclosure, unless otherwise specified and defined, the terms such as "installed", "connected to", "connected with", and "fixed" should be comprehended in a broad sense. For example, these terms may be comprehended as being fixedly connected, removably connected, or integrally connected; may be comprehended as being directly connected, or indirectly connected through an intermediate medium; and may be comprehended as being in an internal communication between two elements or an interactive relationship between two elements. Those of ordinary skill in the art may understand specific meanings of the above terms in the present disclosure based on a specific situation.

In the description of the present disclosure, it should be understood that orientations or position relationships indicated by terms "left", "right", "front", "rear", "top", "bottom", and the like are orientation or position relationships as shown in the drawings, and these terms are just used to facilitate description of the present disclosure and simplify the description, but not to indicate or imply that the mentioned device or elements must have a specific orientation and must be established and operated in a specific orientation. Therefore, these terms cannot be understood as a limitation to the present disclosure.

Embodiment I

Figure 3:
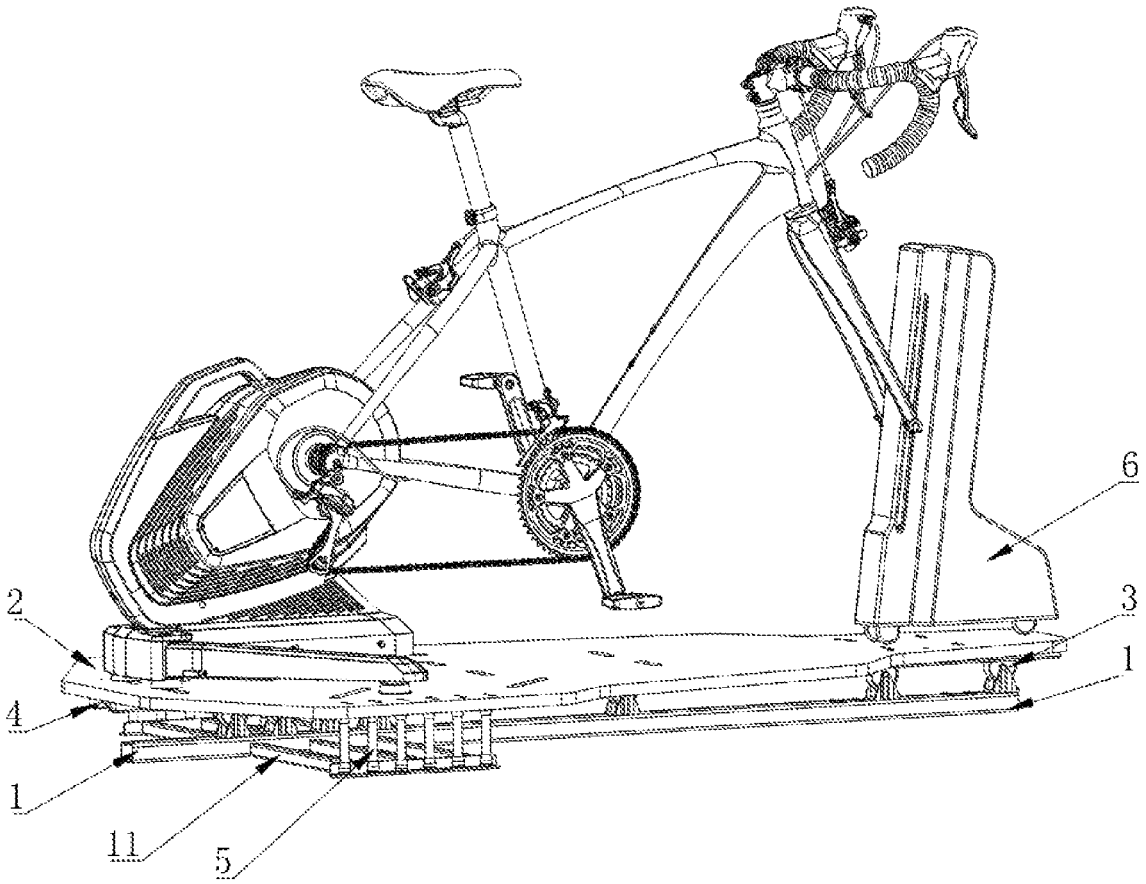
FIG. 3 is a schematic diagram showing an overall structure of the present disclosure.
Figure 4:
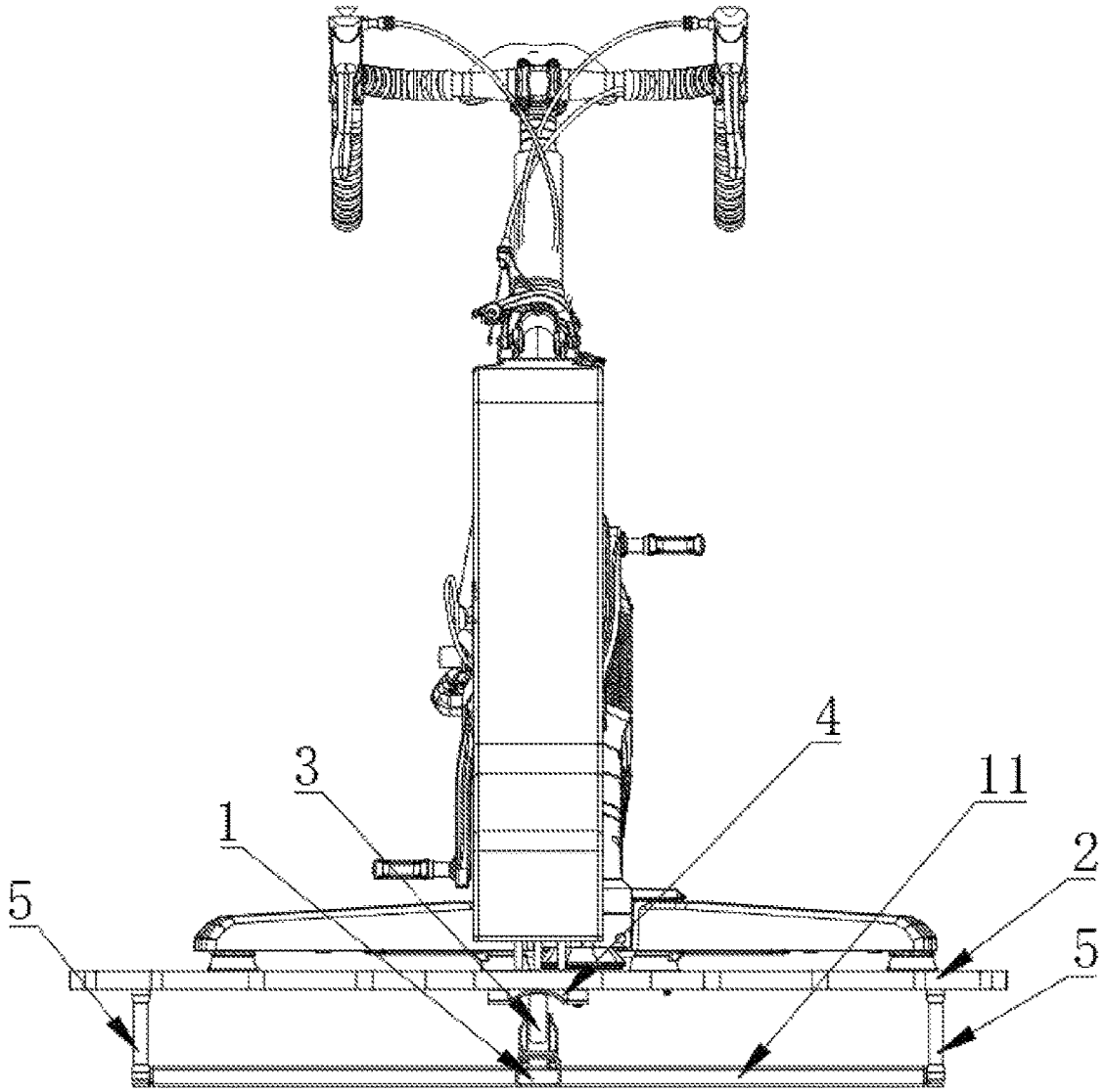
FIG. 4 is a side view of the present disclosure.
Figure 5:
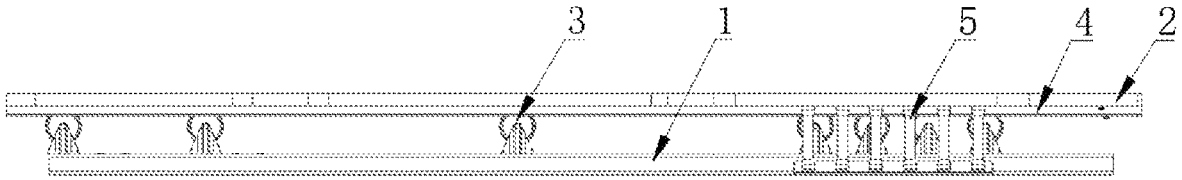
FIG. 5 is a schematic structural diagram between a flat plate and a bracket of a first embodiment in the present disclosure.

As shown in FIG. 3 to FIG. 6, a flexible trainer stand for indoor cycling includes a bracket 1, a flat plate 2, a first guide portion 3, a second guide portion 4, and elastic devices 5. The first guide portion 3 comprises a plurality of rollers and is arranged at a top end of the bracket 1, as shown in FIG. 3 and FIG. 5. The second guide portion 4 is a straight guide rail arranged linearly at a bottom end of the flat plate 2 along a longitudinal axis of the flat plate 2, as shown in FIG. 5. The first guide portion 3 is slidably connected with the second guide portion 4. A beam 11 is fixedly and transversely arranged at one end of the bracket 1, as shown in FIG. 4. The elastic devices 5 are symmetrically arranged at two ends of the beam 11. Each of the elastic devices 5 includes one end fixedly connected with the beam 11, and the other end fixedly connected with the bottom end of the flat plate 2.

In the present disclosure, the first guide portion 3, the second guide portion 4, and the elastic device 5 are arranged, and the first guide portion 3 and the second guide portion 4 can slide relative to each other, which can simulate forward and backward movement of a bike generated when a user accelerates and sprints. The first guide portion 3 and the second guide portion 4 can be inclined, and under an action of the elastic device 5, left and right inclination of the bike generated when the user is cycling can be simulated. Therefore, the above arrangement can enable the user to truly simulate somatosensory feedback during outdoor cycling, and a feedback force can be adjusted, so as to improve an indoor cycling effect.

On the basis of the above technical solution, a contact point of the first guide portion 3 and the second guide portion 4 has a cross section arranged in available forms such as an arc shape, a V shape, or a reuleaux triangle shape. The first guide portion 3 and the second guide portion 4 can slide relative to each other, which can simulate forward and backward movement of a bike generated when the user accelerates and sprints. In addition, angle inclination can also be achieved, such that left and right inclination of the bike generated when the user is cycling can be simulated.

Figure 9:
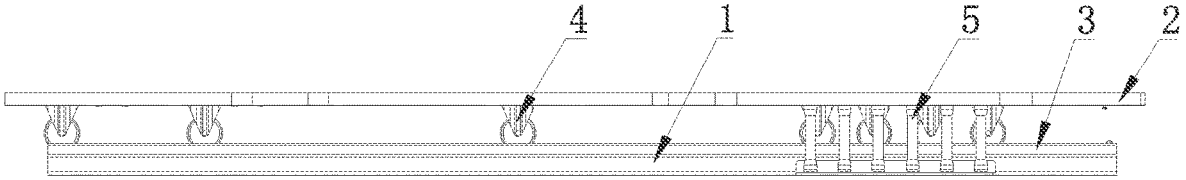
FIG. 9 is a schematic structural diagram between the flat plate and the bracket of a second embodiment in the present disclosure.

On the basis of the above technical solution, the first guide portion 3 comprises the plurality of rollers, and the second guide portion 4 is the straight guide rail, as shown in FIG. 3 and FIG. 5. Alternatively, the first guide portion 3 is the straight guide rail, and the second guide portion 4 comprises the plurality of rollers, as shown in FIG. 9. Installation positions of the first guide portion 3 and the second guide portion 4 can be interchanged, which can meet the needs of use in a high-load use environment.

Figure 6:
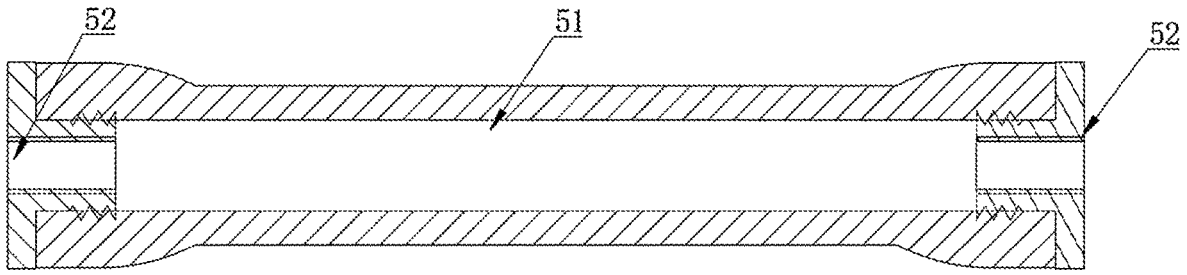
FIG. 6 is a schematic structural diagram of an elastic device in the present disclosure.

On the basis of the above technical solution, as shown in FIG. 6, each of the elastic devices 5 is arranged as a hollow rubber tube 51. Two ends of the hollow rubber tube 51 are each provided with a metal joint 52. A free end of the metal joint 52 is fixedly connected with the bottom end of the flat plate 2 and the beam 11 separately. Preferably, a passive energy storage device such as a spring, an elastic ball, and a gas spring can be selected as the elastic device 5. The above flexible support design reduces a stress on a cycling training frame, prolongs a service life, and reduces training costs. In addition, the number and specification of the elastic device 5 can be replaced, and the elastic device 5 can be selected according to the needs of the user such as an actual weight, which can effectively improve comfort of the user during cycling training.

On the basis of the above technical solution, a plurality of rollers are arranged. The number of the roller can be selected according to the weight of the user and the total weight of equipment carried on the flat plate. In addition, different arrangement forms of the plurality of rollers can be set according to different needs of the user. The feedback force can be adjusted while achieving real somatosensory simulation, so as to improve an indoor cycling effect.

On the basis of the above technical solution, the guide rail has a segmented structure, and any two adjacent sections of the guide rail are detachably connected. By setting the guide rail as segmented, it can be applied to rocker plates of different sizes and has a wide range of application.

During indoor simulation training, when the user exerts a force or accelerates, the left and right inclination of the bike will drive a contact position of the first guide portion 3 and the second guide portion 4 to be inclined with a certain angle. At this time, the elastic device 5 on one side is stretched in a deflection direction of the bike, and the elastic device 5 on the other side is unstressed to complete an energy storage process. When the trend of left and right inclination disappears, the elastic device 5 releases energy stored, and both sides of the flexible trainer stand will return to a horizontal state.

When the user changes the posture to sprint and accelerate, the center of gravity of the body tends to lean forward, and the bike drives the first guide portion 3 and the second guide portion 4 to slide relative to each other. At this time, the elastic devices 5 at two ends of the beam 11 are stretched in a sliding direction to complete the energy storage process. When the trend of forward leaning of the center of gravity disappears, the energy stored is released, and the flexible trainer stand will return to its original position.

Embodiment II

The difference from Embodiment I is that the first guide portion 3 may be arranged as a guide rail, the second guide portion 4 may be arranged as a guide post, the guide post is slidably connected with the guide rail, and angle inclination can also be achieved. Likewise, installation positions of the first guide portion 3 and the second guide portion 4 can also be interchanged. More preferably, the guide post is rotatably connected with the top end of the bracket 1 or the top end of the flat plate 2, such that the bike can be inclined more flexibly during simulation of cycling force exertion.

Embodiment III

Figure 7:
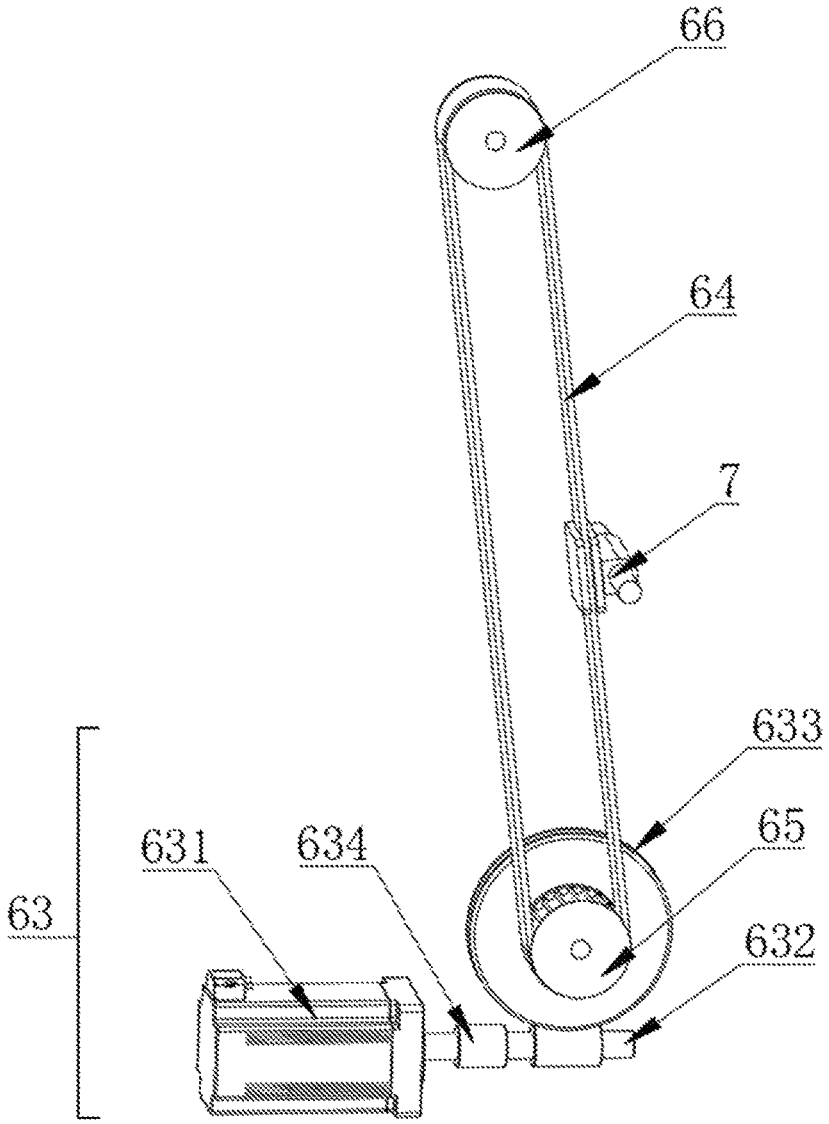
FIG. 7 is a schematic diagram of a lifting device of the present disclosure.
Figure 8:
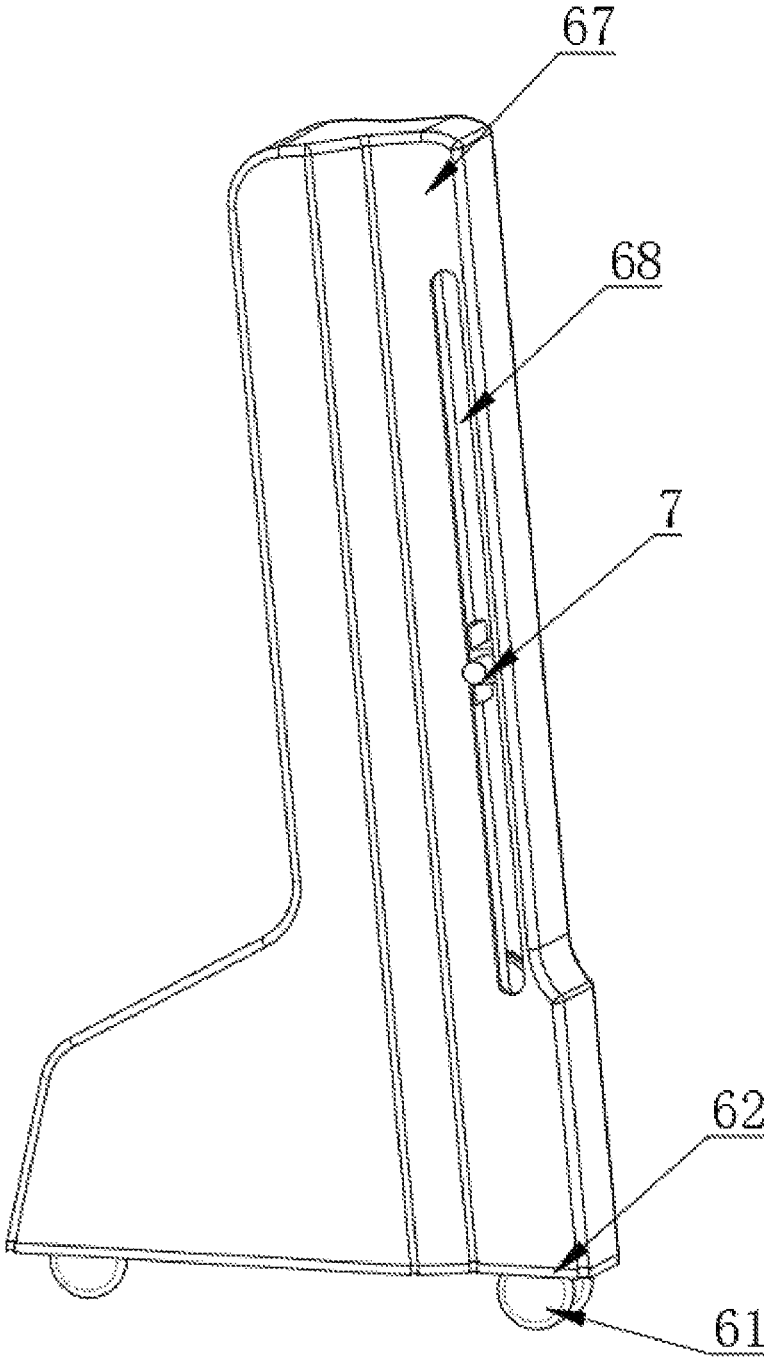
FIG. 8 is a schematic diagram of a shell of the lifting device of the present disclosure.

On the basis of the above embodiments, as shown in FIG. 7 and FIG. 8, the present disclosure further includes a lifting device 6 fixed on the flat plate 2. The lifting device 6 includes a roller 61, a bottom plate 62, a power mechanism 63, a conveyor belt 64, a driving wheel 65, and a driven wheel 66. The roller 61 is arranged at a bottom end of the bottom plate 62. The power mechanism 63 is fixedly arranged at a top end of the bottom plate 62. The driving wheel 65 is arranged coaxially with the power mechanism 63. The driving wheel 65 drives the driven wheel 66 to rotate through the conveyor belt 64. A connecting member 7 is fixedly arranged on the conveyor belt 64.

On the basis of the above technical solution, the power mechanism 63 includes a driving motor 631, a worm 632, and a worm gear 633. The worm 632 is arranged on the driving motor 631 through a coupler 634. The worm gear 633 is meshed with the worm 632. The worm gear 633 is arranged coaxially with and rotates synchronously with the driving wheel 65.

The lifting device 6 is arranged on the flat plate 2, such that the user can simulate position changes of the bike in a vertical direction when a slope changes, and a simulated feedback effect is real, which improves the indoor training effect and experience of indoor cycling. During specific use, a front frame of the bike is fixedly installed on the connecting member 7. The power mechanism 63 is started to drive the driving wheel 65 to rotate. The driving wheel 65 drives the driven wheel 66 to rotate through the conveyor belt 64. The connecting member 7 is driven by the conveyor belt to realize up and down movement, so as to drive the front frame of the bike to realize the position changes in the vertical direction, and truly simulate the slope changes during outdoor cycling.

On the basis of the above technical solution, as shown in FIG. 8, the lifting device 6 is externally provided with a shell 67. A sliding chute 68 is symmetrically formed in a side wall of the shell 67. The connecting member 7 is slidably connected in the sliding chute 68. The lifting device 6 is provided with the shell 67 on the outer side, such that the normal operation of the lifting device 6 can be protected, and potential safety hazards caused by user contact can be avoided. The sliding chute 68 is formed in the side wall of the shell 67 to guide the connecting member 7, so as to prevent the front frame of the bike from shaking and swinging in an up and down lifting process, which affects the user experience.

When the user needs to experience the slope change simulation, the lifting device 6 will receive a power change signal sent by the cycling training equipment such as a bike trainer fixed on the flat plate 2 through a Bluetooth device, and then convert it into slope data. Then the slope data is used in the control of operation of the driving motor 631, and then the conveyor belt 64 is driven to run. The connecting member 7 fixed on the conveyor belt 64 drives the front frame of the bike to change in position in the vertical direction, such that the user can experience the somatosensory feedback brought by the real slope changes.

The present disclosure provides the flexible trainer stand for indoor cycling, which can effectively provide feedback on the road feeling and somatosensory feeling during cycling in real environment. In the training process, the habit of exerting a force and the cycling posture can be adjusted according to the changes of the feedback of the flexible trainer stand to improve the indoor training effect. In addition, the feedback force can be adjusted to adapt to more user groups. Moreover, the present disclosure also has the advantages of simple structure, ultra-silence, and light weight, is convenient to use and carry, can support all commercially available cycling training equipment such as bike trainers and spinning bikes, and has a wide range of application.

The basic principles and main features of the present disclosure and the advantages of the present disclosure are illustrated and described above. For those skilled in the art, it is obvious that the present disclosure is not limited to the details of the above exemplary embodiments, and the present disclosure can be implemented in other specific forms without departing from the spirit or basic features of the present disclosure. The embodiments should be regarded as exemplary and non-limiting in every respect, and the scope of the present disclosure is defined by the appended claims rather than the above description. Therefore, all changes falling within the meaning and scope of equivalent elements of the claims should be included in the present disclosure. Any reference numeral in the claims should not be considered as limiting the involved claims.

In addition, it should be understood that although this specification is described in accordance with the implementations, not every implementation includes only an independent technical solution. Such a description is merely for the sake of clarity, and those skilled in the art should take the specification as a whole. The technical solutions in the embodiments can also be appropriately combined to form other implementations which are comprehensible for those skilled in the art.

What is claimed is:

1. A flexible trainer stand for indoor cycling, comprising:
- a bracket,
- a flat plate,
- a beam fixedly and transversely arranged at one end of the bracket,
- a first guide portion arranged at a top end of the bracket, the first guide portion comprises a plurality of rollers,
- a second guide portion, the second guide portion being a straight guide rail arranged linearly at a bottom end of the flat plate along a longitudinal axis of the flat plate, and
- a plurality of elastic devices symmetrically arranged at two ends of the beam, and each of the plurality of elastic devices comprises a first end fixedly connected with the beam, and a second end fixedly connected with the bottom end of the flat plate,
- wherein the plurality of rollers are configured to roll along the straight guide rail; and
- wherein when a bike, positioned on the flat plate, drives the first guide portion and the second guide portion to slide relative to each other, the plurality of elastic devices at the two ends of the beam are stretched in a sliding direction.

2. The flexible trainer stand for indoor cycling according to claim 1, further comprising a lifting device-fixed on the flat plate, the lifting device comprising:
- a bottom plate,
- a roller arranged at a bottom end of the bottom plate,
- a power mechanism fixedly arranged at a top end of the bottom plate,
- a conveyor belt,
- a driving wheel arranged coaxially with the power mechanism, and
- a driven wheel, the driving wheel drives the driven wheel to rotate through the conveyor belt;
- wherein, a connecting member is fixedly arranged on the conveyor belt and configured to connect the lifting device to the bike.

3. The flexible trainer stand for indoor cycling according to claim 2, wherein the power mechanism comprises a driving motor, a worm, and a worm gear, the worm is arranged on the driving motor through a coupler, the worm gear is meshed with the worm, and the worm gear is arranged coaxially with and rotates synchronously with the driving wheel.

4. The flexible trainer stand for indoor cycling according to claim 2, wherein the lifting device is externally provided with a shell, a sliding chute is symmetrically formed in a side wall of the shell, and the connecting member is slidably connected in the sliding chute.

5. The flexible trainer stand for indoor cycling according to claim 1, wherein a contact point of the first guide portion and the second guide portion has a cross section arranged in an arc shape, a V shape, or a reuleaux triangle shape.

6. The flexible trainer stand for indoor cycling according to claim 1, wherein each of the plurality of elastic devices comprises a hollow rubber tube, and wherein the first end of each of the plurality of elastic devices is provided with a first metal joint having a free end fixedly connected with the beam and the second end of each of the plurality of the elastic devices is provided with a second metal joint having a free end fixedly connected with the bottom end of the flat plate.

7. A flexible trainer stand for indoor cycling, comprising:
- a bracket,
- a flat plate,
- a beam fixedly and transversely arranged at one end of the bracket,
- a first guide portion, the first guide portion being a straight guide rail arranged linearly at a top end of the bracket along a longitudinal axis of the bracket
- a second guide portion arranged at a bottom end of the flat plate, the second guide portion comprises a plurality of rollers, and
- a plurality of elastic devices symmetrically arranged at two ends of the beam, and each of the plurality of elastic devices comprises a first end fixedly connected with the beam, and a second end fixedly connected with the bottom end of the flat plate,
- wherein the plurality of rollers are configured to roll along the straight guide rail; and
- wherein when a bike, positioned on the flat plate, drives the first guide portion and the second guide portion to slide relative to each other, the plurality of elastic devices at the two ends of the beam are stretched in a sliding direction.

8. The flexible trainer stand for indoor cycling according to claim 7, further comprising a lifting device fixed on the flat plate, the lifting device comprising:
- a bottom plate,
- a roller arranged at a bottom end of the bottom plate,
- a power mechanism fixedly arranged at a top end of the bottom plate,
- a conveyor belt,
- a driving wheel arranged coaxially with the power mechanism, and a driven wheel, the driving wheel drives the driven wheel to rotate through the conveyor belt;
- wherein, a connecting member is fixedly arranged on the conveyor belt and configured to connect the lifting device to the bike.

9. The flexible trainer stand for indoor cycling according to claim 8, wherein the power mechanism comprises a driving motor, a worm, and a worm gear, the worm is arranged on the driving motor through a coupler, the worm gear is meshed with the worm, and the worm gear is arranged coaxially with and rotates synchronously with the driving wheel.

10. The flexible trainer stand for indoor cycling according to claim 8, wherein the lifting device is externally provided with a shell, a sliding chute is symmetrically formed in a side wall of the shell, and the connecting member is slidably connected in the sliding chute.

11. The flexible trainer stand for indoor cycling according to claim 7, wherein a contact point of the first guide portion and the second guide portion has a cross section arranged in an arc shape, a V shape, or a reuleaux triangle shape.

12. The flexible trainer stand for indoor cycling according to claim 7, wherein each of the plurality of elastic devices comprises a hollow rubber tube and wherein the first end of each of the plurality of elastic devices is provided with a first metal joint having a free end fixedly connected with the beam and the second end of each of the plurality of elastic devices is provided with a second metal joint having a free end fixedly connected with the bottom end of the flat plate.

* * * * *